US006569593B2

(12) United States Patent
Bourdelais et al.

(10) Patent No.: US 6,569,593 B2
(45) Date of Patent: May 27, 2003

(54) ORIENTED POLYESTER IMAGING ELEMENT WITH NACREOUS PIGMENT

(75) Inventors: Robert P. Bourdelais, Pittsford, NY (US); Peter T. Aylward, Hilton, NY (US); Narasimharao Dontula, Rochester, NY (US); Alphonse D. Camp, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/931,699

(22) Filed: Aug. 16, 2001

(65) Prior Publication Data

US 2003/0044737 A1 Mar. 6, 2003

(51) Int. Cl.[7] ..... G03C 1/765; G03C 1/795; G03C 1/91; G03C 1/45; G03C 8/52

(52) U.S. Cl. ..... 430/201; 430/11; 430/14; 430/220; 430/496; 430/510; 430/527; 430/533; 347/106

(58) Field of Search ..... 430/220, 510, 430/523, 533, 527, 11, 14, 496, 201; 347/106

(56) References Cited

U.S. PATENT DOCUMENTS

| | | | | | |
|---|---|---|---|---|---|
| 3,222,439 | A | | 12/1965 | Bolomey et al. | |
| 4,216,018 | A | | 8/1980 | Bilofsky et al. | 430/220 |
| 4,269,916 | A | | 5/1981 | Bilofsky et al. | 430/220 |
| 4,288,524 | A | | 9/1981 | Bilofsky et al. | 430/220 |
| 4,579,810 | A | * | 4/1986 | Johnston et al. | 430/533 |
| 4,910,235 | A | * | 3/1990 | Satake et al. | 523/171 |
| 5,340,692 | A | | 8/1994 | Vermeulen et al. | 430/233 |
| 5,466,519 | A | | 11/1995 | Shirakura et al. | 430/538 |
| 5,733,658 | A | | 3/1998 | Schmid et al. | |
| 5,837,359 | A | | 11/1998 | Shetty et al. | |
| 5,858,078 | A | | 1/1999 | Andes et al. | |
| 5,866,282 | A | | 2/1999 | Bourdelais et al. | 430/536 |
| 5,888,681 | A | | 3/1999 | Gula et al. | 430/536 |
| 6,030,759 | A | | 2/2000 | Gula et al. | 430/536 |
| 6,071,654 | A | | 6/2000 | Camp et al. | 430/536 |
| 6,071,680 | A | | 6/2000 | Bourdelais et al. | 430/536 |
| 6,146,744 | A | | 11/2000 | Freedman | 428/516 |
| 6,165,700 | A | | 12/2000 | Camp et al. | 430/536 |
| 6,274,284 | B1 | | 8/2001 | Aylward et al. | |

FOREIGN PATENT DOCUMENTS

| | | |
|---|---|---|
| FR | 1469839 | 2/1967 |
| GB | 1487414 | 9/1977 |

OTHER PUBLICATIONS

Japanese Patent Abstract No. JP6322147 A.
Japanese Patent Abstract No. JP61259246 A.

* cited by examiner

*Primary Examiner*—Richard L. Schilling

(57) ABSTRACT

This invention relates to an imaging element comprising at least one layer of oriented polyester and nacreous pigment.

44 Claims, No Drawings

ORIENTED POLYESTER IMAGING ELEMENT WITH NACREOUS PIGMENT

FIELD OF THE INVENTION

This invention relates to imaging media. In a preferred form, it relates to supports for photographic, ink jet, thermal, and electrophotographic media.

BACKGROUND OF THE INVENTION

In order for a print imaging support to be accepted for consumer or commercial imaging applications, it has to meet requirements for such base properties as weight, caliper, stiffness, smoothness, gloss, whiteness, and opacity. Additional the image must provide value to the end customer. This may be a traditional replication of the image or it may provide an added dimensional that further stimulates the viewer. This may be a sense of depth, wild vibrate colors or a more subdued pearl-like iridescence.

Prior art reflective imaging output materials such as silver halide reflective images or ink jet reflective images typically comprise imaging layers applied to a white reflective base material. The white reflective base reflects ambient light back to the observer's eye to form the image in the brain. Prior art base materials typically utilize white reflecting pigments such as $TiO_2$ or barium sulfate in a polymer matrix to form a white reflective base material. Prior art reflective photographic papers also contain white pigments in the support just below the silver halide imaging layers to obtain image whiteness and sharpness during image exposure, as the white pigment reduces the amount of exposure light energy scattered by the cellulose paper core. Details on the use of white pigments in highly loaded coextruded layers to obtain silver halide image sharpness and whiteness are recorded in U.S. Pat. No. 5,466,519.

It has been proposed in U.S. Pat. No. 5,866,282 (Bourdelais et al) to utilize a composite support material with laminated biaxially oriented polyolefin sheets as a photographic imaging material. In U.S. Pat. No. 5,866,282, biaxially oriented polyolefin sheets are extrusion laminated to cellulose paper to create a support for silver halide imaging layers. The biaxially oriented sheets described in U.S. Pat. No. 5,866,282 have a microvoided layer in combination with coextruded layers that contain white pigments such as $TiO_2$ above and below the microvoided layer. The composite imaging support structure described in U.S. Pat. No. 5,866,282 has been found to be more durable, sharper and brighter than prior art photographic paper imaging supports that use cast melt extruded polyethylene layers coated on cellulose paper.

In U.S. Pat. No. 6,146,744 (Freedman) high aspect ratio filler particles are added to composite facestock and liner sheets to provide increased mechanical stiffness compared to polymer facestock and liner materials that do not contain filler particles. While high aspect ratio filler particles added to the base layer in an amount between 5% to 40% by weight does improve the stiffness of the liner and facestock, the filler particles do not provide a nacreous appearance. Further, the high aspect ratio particles are added to the core of the facestock and liner and not to the printed layers. It has been shown that high aspect ratio particles added to the core of a facestock do not provide adequate multiple reflection planes in combination with a dye based imaging system to provide the desired nacreous appearance. High aspect ratio particles provide a nacreous appearance when they are located adjacent to the dye based imaging layers. Further, not attempt was made to improve the reflectivity of the high aspect ratio particles and thus are not suitable for the formation of photographic images.

It has been proposed in U.S. Pat. No. 6,071,680 (Bourdelais et al) to utilize a voided polyester sheet coated with light sensitive silver halide imaging layers for use as photographic output material. The voided layer in U.S. Pat. No. 6,071,680 improves opacity, image lightness, and image brightness compared to prior art polyethylene melt extrusion coated cellulose paper base materials. The image base proposed in U.S. Pat. No. 6,071,680 also contains an integral polyolefin skin layer to facilitate imaging layer adhesion at the time of manufacture and during the processing of silver halide imaging layers.

There, however, remains a continuing need for improvements to the appearance of imaging output materials. It has been shown that consumers, in addition to reflective output material, also prefer nacreous images. Nacreous images exhibit a pearly or nacreous luster, an iridescent play of colors, and a brilliant luster that appears in three dimensions. Nacreous appearance can be found in nature if one examines a pearl or the polished shell of *Turbo marmoratus*.

A nacreous photographic element with a microvoided sheet of opalescence is described in U.S. Pat. No. 5,888,681 (Gula et al). In U.S. Pat. No. 5,888,681 microvoided polymer sheets with microvoided polymer layer located between a cellulose paper base and developed silver halide imaging provide an image with an opalescence appearance. The nacreous appearance is created in U.S. Pat. No. 5,888,681 by providing multiple internal reflections in the voided layer of the polymer sheet. While the opalescence appearance is present in the image, the image suffers from a loss of image sharpness or acutance, a higher density minimum position, and a decrease in printing speed compared to a typical photographic image formed on a white, reflecting base. It would be desirable if the opalescent look of the image could be maintained while improving printing speed, increasing sharpness, and decreasing density minimum. Also, while the voided polymer does provide an excellent nacreous image, the voided layer, because it is pre-fractured, is subjected to permanent deformation, thus reducing the quality of the image. The image obtained from this invention have a strong glossy in appearance which is desirable in some situations but in the field of fine art and portrait imaging, being able to eliminate the harsh glare in very desirable. In this area of imaging, a very soft appearance is very desirable. In the case of weddings, it is very difficult to capture the rich lustrous satin appearance and feel of a wedding gown when the imaging element has a high level of metallic like gloss.

Nacreous pigments added to a matrix, such as paint or plastic, have been known to exhibit a nacreous appearance. The prior art use of the nacreous pigments have been for pigmenting paints, printing inks, plastics, cosmetics, and glazes for ceramics and glass. Nacreous pigments are dispersed in a matrix and then painted or printed onto a substrate. Pearl luster pigments containing titanium dioxide have been successfully employed for many years. They are constructed in accordance with the layer substrate principle, with mica being employed virtually without exception as substrate.

Mica pigments are used widely in the printing and coating industries, in cosmetology, and in polymer processing. They are distinguished by interference colors and a high luster. For the formation of extremely thin layers, however, mica pigments are not suitable, since the mica itself, as a substrate for the metal-oxide layers of the pigment, has a thickness of from 200 to 1200 nanometer. A further disadvantage is that the thickness of the mica platelets within a certain fraction defined by the platelet size in some cases varies markedly about a mean value. Moreover, mica is a naturally occurring mineral which is contaminated by foreign ions. Furthermore, technically highly complex and time-consuming processing steps are required including, in particular, grinding and classifying.

Pearl luster pigments based on thick mica platelets and coated with metal oxides have, owing to the thickness of the edge, a marked scatter fraction, especially in the case of relatively fine particle-size distributions below 20 micrometers. As a substitute for mica, it has been proposed to use thin glass flakes which are obtained by rolling a glass melt with subsequent grinding. Indeed, interference pigments based on such materials exhibit color effects superior to those of conventional, mica-based pigments. Disadvantages, however, are that the glass flakes have a very large mean thickness of about 10–15 micrometers and a very broad thickness distribution (typically between 4 and 20 micrometers), whereas the thickness of interference pigments is typically not more than 3 micrometers.

In U.S. Pat. No. 5,340,692 (Vermeulen et al) an imaging receiving material with nacreous pigment for producing contone images according to the silver salt diffusion process is disclosed. According to the process disclosed in U.S. Pat. No. 5,340,692, contone images with an antique look can be obtained utilizing the silver salt diffusion transfer process without the need of special processing liquids using a nacreous pigment in the imaging receiving layer or located between the support and the image receiving layer. The silver halide imaging layers used are created with retained silver and, therefore, are not semitransparent. Because the nacreous pigments used are contained in the imaging receiving layer and not silver halide imaging layer, the image form will not have a uniform nacreous appearance, as the density of the transferred silver halide image block the multiple reflections from the nacreous pigments. Further, the nacreous pigments utilized are too large and in too great a concentration to be included in the silver halide imaging layer as a rough surface would result, reducing the desired nacreous appearance of the image. The gold flakes used in the example in U.S. Pat. No. 5,340,692 are an attempt to simulate prior art black-and-white photographic "Sepatone" appearance produced during a post process treatment of the imaging layers. While the image in the example does have an antique appearance, the image does not have a nacreous appearance.

In U.S. Pat. No. 4,269,916 (Bilofsky et al) and related patents U.S. Pat. No. 4,288,524 and U.S. Pat. No. 4,216,018, instant photographic products having reflective layers which comprise lemellar interference pigments are disclosed. The intended use of the lemellar pigments is to create a pleasing white reflective appearance for the base material without the need for blue tints. It has been proposed that flat particles of metal oxides created by coating salts with metal oxides and later dissolving the salts leaving a thin flake of metal oxide as; a substitute for spherical $TiO_2$ particles. Titanium dioxide particles typically are utilized in photographic art to create a white reflective surface for the viewing of print materials. The intent of U.S. Pat. No. 4,269,916 is to provide a white reflecting surface that does not have an angular viewing appearance and a consistent L*, thus the invention materials do not exhibit a nacreous appearance. Examples in U.S. Pat. No. 4,269,916 show high reflectivity at a variety of collection angles which is opposite of a nacreous appearance where reflectivity changes as a function of collection angle. Further, the lemellar pigments are not present in the silver halide imaging layers or in the base materials used in the invention.

In U.S. Pat. No. 5,858,078 (Andes et al), a process for the production platelet like, substrate free $TiO_2$ pigment is disclosed for use in printing inks, plastics, cosmetics and foodstuffs is.

In U.S. Pat. No. 5,733,658 (Schmid et al) luster pigments obtainable by treating titania coated silicate based platelets from 400° C. to 900° C. with a gas mixture comprising a vaporized organic compound and ammonia are described as useful for coloring paints, inks, plastics, glasses, ceramic products, and decorative cosmetic preparations.

It has been shown that when imaging layers (silver halide, ink jet, flexography, laser toner, and the like) are applied to nacreous base materials, the nacreous appearance of the image is optimized when the image forming layers contain semitransparent dyes. The use of pigmented inks and dyes in the imaging layers tend to reduce the nacreous appearance of the image. In U.S. Pat. No. 6,071,654 (Camp et al) silver halide imaging layers that are semitransparent are coated on a nacreous support containing a voided polymer layer. The voided polymer layers create flat platelets oriented parallel to each other. The reflection which reaches the eye is primarily specular. It arises in depth, since each transparent polymer platelet reflects some of the incident light and reflects the remainder. The images in U.S. Pat. No. 6,071,654 exhibit a nacreous appearance.

The use of upper surface roughness is described is U.S. Pat. No. 6,165,700 to provide a nonglossy photographic display material that utilizes biaxially oriented sheets for display purposes. The images on these materials are matte and dull appearing. There remains a need for a non-glossy print material that has a lustrous sheen or satin appearance to the image.

PROBLEM TO BE SOLVED BY THE INVENTION

There is a need for a reflective imaging material that provides a nacreous or pearlescent appearance.

SUMMARY OF THE INVENTION

It is an object of the invention to provide improved imaging materials.

It is another object to improved image appearance compared to prior art voided base imaging materials.

It is a further object to provide imaging materials that have a lustrous satin sheen.

These and other objects of the invention are accomplished by an imaging element comprising at least one layer of oriented polyester and nacreous pigment.

ADVANTAGEOUS EFFECT OF THE INVENTION

The invention provides soft, subtle images that have a lustrous satin sheen. The invention may be used with a variety of imaging methodologies and is particularly useful in better replicating the sheen of satin.

DETAILED DESCRIPTION OF THE INVENTION

The invention has numerous advantages:over prior nacreous materials. The nacreous materials of the invention provide very efficient optical reflection of light that changes the appearance of the image when viewed from various angles. Furthermore this invention provides a means to control the relative level of nacreous appearance. Prior art materials while providing a unique dynamic and vibrant look that is useful in certain areas, needs to be muted or toned down for other applications. By the use of nacreous pigments, it is shown that a much softer pearl appearance may be achieved. This is very useful in the field of fine arts and commercial application when the desire is to provide a much softer appearance. The layers of the coextruded polyester sheet useful in this invention have levels of nacreous pigments, optical brightener, and colorants adjusted to provide optimum reflective properties.

Furthermore the nacreous imaging materials of the invention provide an eye-catching appearance that makes them particularly desirable in imaging applications that require obtaining the attention of the consumer. One example includes display materials that are intended to communicate an advertising message to people in a public setting such as a bus stop, train station, or airport. The nacreous images are differentiated in look from prior art materials and, thus, provide the pop and sizzle that can catch the consumer's attention. By providing the nacreous image with a pressure sensitive adhesive, the tough, durable nacreous image can be applied to various surfaces, which is particularly desirable for the youth market.

Photographic nacreous imaging materials of the invention when utilized in packaging markets enable a differentiated look and consumer appeal on store shelf. The utilization of the thin, flexible, and tough silver halide materials results in a packaging material having many superior properties. The packaging materials utilizing the invention have a depth of image unsurpassed by existing packaging materials. The invention may be utilized with a variety of packaging materials that are suitable pressure sensitive labeling, such as shampoo bottles, perfume bottles, and film boxes. The invention, while having the advantage of superior image, may be available on thin base materials which are low in cost while providing superior opacity and strength. The materials of the invention, as they may be imaged by flash optical exposure or digital printing, have the ability to be formed in short runs and to be rapidly switched from one image to the next without delay.

The term "nacreous" refers to a pearly, luster, and nacreous appearance. This may include a metallic, lustrous, and somewhat iridescent effect. The nacreous effect is the result of interference pigments that are platelet-like in their structure. Typically these are elongated platelet-like structures of silicate-based materials such as mica, feldspar, and quartz. These pigments tend to cause specular and diffuse reflection, and they also transmit some light. The use of nacreous pigments in the paint and printing industry are typically designed to create a variety of eye-popping colors. These materials are typically coated over dark black backgrounds to help accentuate the eye-popping optical effects. Special metal oxide coatings are applied to mica particles in very thin layers. This allows for some light to be refracted, while other light will transmit through to the near transparent layers of the mica particle to be refracted at a slightly different angle. Since these pigments are suspended in a binder polymer of yet another refractive index, there are multiple light refractions that create a lustrous appearance. In addition, the chemistry of the coating that is applied to the mica particles may be varied to create various colors. Metal oxide coatings that may be used in an embodiment of this invention include titanium, iron, chromium, barium, aluminum, zinc, zirconium, bismuth vanadate, nickel titanate, chromium titanate, lead, and others. While these produce some exciting colors in the field of photography and imaging, traditional print materials have a white background. Additionally, it should be noted that the thickness of the metal oxide coating on the mica may also impact the color. In a preferred embodiment of this invention the metal oxide coating on the mica particles may comprise titanium, aluminum, and/or barium. These materials are preferred because it is desirable to have a more traditional white background that can be utilized with these materials. The most preferred metal oxide is titanium because of its superior whiteness. Typically it is important to control the thickness of the metal oxide coating to less than 120 nanometers to achieve a blue white appearance.

With nacreous pigments used in imaging application, it may be desirable to have non-uniform platelet thickness and small particles to create a white nacreous appearance. In imaging application where a different look is desirable, the use of thicker particles and more uniform spacing of platelets to each other create color interference that is more characteristic of mother-of-pearl. In general, the lustrous pigments referred to in this invention are pigments that consist of flat mica platelets coated with titanium dioxide or other metal oxides. They are irregular in shape and may vary in thickness from 0.1 to 0.5 micrometers, although some individual particles may be thicker. The particles may have a length of up to 500 micrometers. The coating applied to the mica particles should be controlled in thickness, but the overall thickness is one parameter that controls the overall color appearance. Each transparent coating helps to create the lustrous or pearlescent effect. The particle of these pigments influences the perceived texture of the pearl luster effect and adds a new dimension of beauty and quality to the image. The coating may be colored with other compatible transparent pigments and dyestuffs. Metallic effects can be simulated by adding small amounts of carbon black with some silvery white pigments. The color seen is different than color pigments and dyes in that the color and lustrous iridescence is produced by light interference and not absorption or reflection of light. This is a suprisingly unique attribute to the field of silver halide photography and imaging. With the use of nacreous pigments there are many refractive interfaces that can produce a unique appearance to an imaging element. A light ray striking a layer containing nacreous platelets must pass through a substantially transparent layer of relatively lower refractive index binder polymer surrounding the platelet, and then the ray is then partially reflected by the metal oxide coating on the surface. The remaining part passes into the metal oxide coating layer and is again reflected as it exits the layer at the interface with the mica particle. Since the coating is very thin and the mica platelets are substantially transparent, the remaining light has many opportunities to be reflected at different angles. This helps to provide the luster nacreous appearance, as well as to add a three-dimensional quality to the image. The resulting color effect that is produced depends on the light reflection from the interfaces, as well as the type of coating on the mica particles. The multiple interfaces cause the reflected light to be slightly out of phase. It should also be noted that the color varies based on the angle of illumination and that an iridescence effect can be seen. Control of this effect is desirable depending on the effect that needs to be conveyed by the image. As noted above the thickness and type of the coating on the mica particles are factors that need to be considered. In addition the particle size can also be used to control the effect. For use in a photographic element it is desirable to have a smooth surface. To achieve this, a small particle is best but the layer thickness of the binder polymer in which the pigments are suspended may also be increased as well as applying clear overcoats. Larger particles are desirable when a bold effect with visual impact is desired. The nacreous effect can be changed by adjusting the particle size, metal oxide coating thickness and type, as well as the concentration of the pigment. In general, low pigmentation levels are better at producing a three-dimensional effect. This effect may be enhanced by applying a thick clear layer over the top of the nacreous pigments. When a more metallic sheen is desired, higher pigmentation levels are best. It should also be noted that different effects may be achieved by adding other transparent pigments and dyes in the layers. Since light sensitive photographic layers produce dye couplers that are semitransparent and typically do not contain pigment particles; they are uniquely positioned to be able to create synergistic effects with the nacreous pigments.

The nacreous pigments are relatively stable and generally resistant to alkali and acids, as well as high temperature. They can be dispersed in most carrying (binder polymer) media. Since the particles are substantially transparent, the use of a carrying media that is also transparent provides the maximum effect. If a more translucent carrying media is used, more nacreous pigment may be needed to achieve the same level of nacreous appearance.

In some applications it may be desirable to have a nacreous pigment that is also conductive. This has some unique advantages in the area of photographic light sensitive layers. Static accumulation and discharge can result in a fogged layer. Being able to provide a conductive path that helps to prevent the charge from building up is an important element for imaging media. This not only helps prevent light fogging of light sensitive layer, but also allows sheets to slide over each other and various equipment parts without static buildup or cling of one sheet to another. This type of pigment is also a means of adding conductivity to the emulsion side of a photographic element. Conductive nacreous pigments consist of an inner core of platelet mica that is coated with materials such as $TiO_2$, $SiO_2$ and further coated with an outer layer of dense layer of conductive, inorganic mixed metal oxide. A typical material is antimony-doped tin dioxide. The elongated particles of mica are useful in providing a conductive pathway when particles are touching.

The origin of the beauty of a genuine pearl has been well documented. It is known that its luster and color come from the multiple smooth concentric layers of nacre, i.e., calcium carbonate layer, organic constituent (conchiolin) layer. Each of these layers partially reflects and transmits light. Hence, a sense of depth and luster is observed in the reflection. Pigments that try to simulate the visual effect of a pearl are called as pearlescent or nacreous pigments. The first nacreous pigment was the natural pearl. The commercial grades of nacreous pigments are made of thin transparent platelets of high refractive index. These pigments are so designed that multiple reflections and transmissions occur and, as a result, a sense of depth is obtained in the overall reflected image. The characteristics of the pigment determine whether color is produced by light interference (specifically called as interference pigments) or no color is produced (called as white nacreous pigments).

Some of the earliest pearlescent pigments were the platelike bismuth oxychloride crystals, and basic lead carbonate. These pigments reflect light similar to a pearl essence crystal. Due to toxicity of lead, bismuth oxychloride (BiOCl) crystals have seen an increased use in the marketplace. BiOCl is generally crystallized from solution into smooth, thin platelets which has a particle size ranging from 5 micrometer to 15 micrometer.

The other commonly used pearlescent pigments are those made from mica coated with either titanium dioxide (U.S. Pat. No. 4,040,859), iron oxide (U.S. Pat. No. 3,087,829), zirconium dioxide (U.S. Pat. No. 3,087,828), or other high refractive index materials. Mica is used because it is transparent to light and can be cleaved into extremely thin flakes. Examples of mica suitable for pearlescent pigments are muscovite, paragonite, phlogopite, biotite, and lepidolite. The mica platelets are then coated with a thin single layer or multiple layers of high refractive index inorganic oxide. The reflection efficiency depends to a large extent on the refractive index difference between the mica platelet and the inorganic oxide coating. This layered structure enables it to function like a pearlescent pigment. The oxide coating provides the optical effects like luster, interference reflection color (if oxide coating is sufficiently thick) and absorption color (if the oxide contains color material). The size of the mica particle also plays an important role in determining the final reflected image. The weight of the mica in the pigment usually lies between 40% and 90% and most usually in the range of 60% and 80%. If titanium dioxide is used as the coating and its coating thickness is increased, then an iridescence effect (color) is observed. The dimensions of pearlescent pigments used in this invention may be between 5 micrometer and 400 micrometer and preferably between 5 micrometer and 100 micrometer because particles less than 5 micrometer are not very efficient in creating the nacreous appearance, while particles greater than 100 micrometer progressively get rougher. Excessive roughness on the surface tends to shut down the nacreous appearance. The thickness of the pigment is preferably between 0.1 micrometer and 0.6 micrometer and more preferably between 0.2 micrometer and 0.4 micrometer. Particles less than 5 micrometer or less than 0.2 micrometer typically do not have sufficiently higher nacreous appearance, while particles greater than 400 micrometer in length or 0.6 micrometer in width typically are very large and tend to create roughness which starts to shut down the nacreous effect.

Other optically variable pigments that are suitably used are silicon oxide coated with thin layers of aluminum (5 nanometer and 10 nanometer) or titanium dioxide, and magnesium fluoride crystals coated with chromium have also been used. These pigment structures have been highlighted in U.S. Pat. No. 3,438,796. New optically variable pigment structures based on coated platelet like metallic substrates have been disclosed in U.S. Pat. No. 5,364,467 and U.S. Pat. No. 5,662,738. U.S. Pat. No. 5,976,511 discloses pigments composed of barium sulfate particles and coated with zinc oxide, cerium oxide, or titanium dioxide which have a pearly luster.

The photographic elements of this invention may utilize an integral emulsion bonding layer that allows the emulsion to adhere to the support materials during manufacturing and wet processing of images without the need for expensive subbing coatings.

The terms as used herein, "top", "upper", "emulsion side", and "face" mean the side or toward the side of an imaging element or photographic element bearing the imaging layers. The terms "bottom", "lower side", and "back" mean the side or toward the side of the photographic member or imaging element opposite from the side bearing the imaging layers or developed image. Nacreous appearance is a pearly, luster, iridescent, metallic sheen. A characteristic property of a nacreous appearance is an angular dependence of viewing angle. The term substantially free of voids means that greater than 85% of the volume of the layer has is solid polymer or pigment. When using large modified mica particles and then stretching the film, it is often difficult to prevent some void formation as the polymer matrix is stretched across the surface of the large particles.

For the imaging element of this invention, imaging layers are generally applied to a white reflective base, and the image layers comprise nacreous materials. In the invention a photographic element comprises nacreous pigments. This embodiment is preferred because said photographic element that comprises nacreous pigment has a unique pearly lustrous appearance. Such a photographic element has a unique capability to preserve images with special luster sheen that is not available in traditional photographs or commercial displays. A preferred embodiment of this invention comprises nacreous material in a photographic layer that is on a white reflective base. The white reflective base provides an excellent surface and background while viewing prints. In particular, it is desirable to have a white reflective base that has an L* of greater than 92. L* greater than 92 are desirable because they provide good contrast to the image and are pleasing to the viewer. Highly reflective whites are highly desirable from a final consumer standpoint. L* or lightness and opacity were measured for using a Spectrogard spectrophotometer, CIE system, using illuminant D6500.

Nacreous or pearlescence appearing media has shown to be highly desirous from a commercial standpoint. Incorporation of nacreous pigments in a substantially transparent substrate or construction of composite materials containing localized voiding of a specific geometry, orientation, and formulation can produce both "colored" nacreous and "white" nacreous media. For both types, this nacrescence results in perceived depth, luster, and a metallic appearance. Correct measurement of these materials is required for robust design.

For both pigment and voiding methods, "white" nacreous luster is a function of the orientation, as well as the spacing and composition of the materials. The luster and depth appearance of the media are mainly due to the reflected light that reaches the eye. Both pigments and voids that provide a nacreous appearance function as substantially transparent platelets oriented parallel to each other. This results in depth as each platelet reflects some of the incident light while transmitting the rest. Any imperfections due to surface defects or platelet or void orientation misalignments will cause the light to be scattered in a non-specular direction, and will degrade the nacreous appearance of the material.

In addition, the natural tendency for randomness in regards to platelet or void alignment and spacing will render the media incapable of producing color by light interference. Any color produced by one alignment and spacing will have a tendency to be counteracted by other encountered alignments and spacing. However, gross geometric misalignments of the platelets or voids will also result in less than desirable functionality, and a method of measuring this defect is required as well.

FLOP is a test method used to measure the nacreous quality of materials of interest. 45-degree incident light is collected at 10, 45, and 110 degrees from the specular reflection angle. The spectrophotometric output, e.g., CIE L* (L1*, L2*, L3* respectively) is used as follows:

$$FLOP=15(L1^*-L3^*)^{1.11}/L2^{*0.86}$$

whereby FLOP values between less than 10 have no nacreous appearance and FLOP values greater than 10 are indicative of a nacrescent appearance.

Furthermore, quality monitoring of these nacreous materials, when combined with one or more semitransparent color forming dyes layers, places limitations on the usefulness of measurements taken with typically found reflection densitometers having 0/45 geometry. This is due to the angular dependency of these media. This angular viewing dependency of the media and the inherent randomness of the structure will result in errors "reading out" the dye formed due to the variability of the media at any one collection angle. These highly specular and translucent materials will reflect some light in angular dependent non-specular directions as well. It has been found that although incident light and collection at 0/45 will allow for a prediction of density minimum versus FLOP, these values are no longer predictive, as density increases from density minimum to density maximum as color dye forming layers are added to the media.

This can be explained as a function of the dye density. As density increases, the ability for multiple reflections through the media decreases. As the reflection passes approach one, the nacreous look will no longer be apparent.

Spectrogoniometric measurements can be employed to measure the media at various angles, but spectrogoniometric readings are tedious and the apparatus is expensive. An alternative for quality monitoring purposes to assess the amount of color forming layers coated and subsequently processed would be useful. During a color photographic coating operation, the need to reduce inherent manufacturing variability of color forming coupler levels is required and this data collection by conventional reflection 0/45 densitometry is impeded by the natural variability found in the nacreous media. Slight changes in the reflective properties of the base media will result in more or less light reaching the densitometer which, in turn, can result in an erroneous readout of the formed dye.

One such method to provide correct assessment during a coating operation would be to remove the nacreous properties of the media. This can be accomplished by collecting light from the prepared sample at a grazing angle that would minimize the nacreous layer contributions. Diffuse 8 degree sphere optical geometry handheld spectrophotometers have been shown to meet this need.

In a preferred embodiment of this invention, said photographic element comprising nacreous pigments wherein said element has a flop measurement of between 2 and 65. Flop measurements below 2 have little or no nacreous appearance, while flop measurements above 65 are difficult to achieve with nacreous pigments.

The coextruded polyester base of the invention may contain a clear or opaque polyester layer to provide stiffness and further enhance the overall optical properties of the sheet or it may be a thin sheet that is adhesively adhered to a substrate such as paper, cloth, polyester or other polymer based sheets.

The polyester sheet of this invention preferably has a layer or surface chemistry that promotes adhesion to the imaging layer. It may be either a coextruded integral layer such as polyethylene or a copolymer or a primer layer that is coated top of the polyester. Either the coextruded polyethylene layer or primer may be used with corona discharge treatment to further enhance or modify the surface for optimum adhesion to silver halide emulsion or other imaging layer. A polyethylene layer with corona discharge treatment is preferred because gelatin based silver halide emulsions adhere well to treated polyethylene without the need for primer coatings. Suitable primers of the preferred embodiments of this invention may include polyethylene-imine with or with an overcoat of a gelatin based sub layer or it may be a latex terpolymer of acryonitrile, vinylidene chloride and acrylic acid with a gel sub overcoat. Polyethylene imine is preferred because it is easy to apply in a very thin optical clear layer. In other embodiments the latex terpolymer is preferred because it may be applied to the polyester sheet prior to stretching thus avoiding costly post stretching coating processes. In the case of an integral polyethylene skin layer, said layer may further contain blue tints and optical brightener to compensate for the native yellowness of the gelatin based silver halide emulsion. The oriented polyester sheet of this invention is also low in cost, as the functional layer is coextruded at the same time, avoiding the need for further processing such as lamination, priming, or extrusion coating. The nacreous pigments as used in this invention may be in a layer above other layers that contain highly diffusive white pigment such as $TiO_2$. The coextruded cast polyester sheets of this invention are stretched in at least one direction. Preferably they are stretched biaxially either simultaneously or in one direction or then the other direction.

The materials are low in cost as the coextruded polymer material sheet is made in one step. The invention allows the nacreous pigments to work in conjunction with the white pigment to provide a white appearing imaging material that has a soft iridescence. The imaging material of the invention will appear white to the observer but also provides a warm sense of pearl-like iridescence.

The terms as used herein, "top", "upper" "emulsion side", and "face" mean the side or toward the side carrying the image. The terms "bottom", "lower side", and "back" mean the side opposite the image layer.

The layers of the coextruded biaxially oriented polyester sheet of this invention have levels of nacreous pigment, $TiO_2$ and colorants adjusted to provide optimum reflective properties. It should be noted that $TiO_2$ or other white diffusive pigments should be below the nacreous pigment or in sufficiently low amounts so as not to eliminate the nacreous appearance. Highly diffuse inorganic pigments or high level of dye based materials tend to mute the effect of the nacreous pigments.

Any suitable polyester sheet may be utilized for the imaging element base member provided that it is oriented. The orientation provides added strength to the multi-layer structure that provides enhanced handling properties when displays are assembled.

The total thickness of the sheet can range from 12 to 256 micrometers, preferably from 20 to 150 micrometers. Below 20 micrometers, the sheets may not be thick enough to minimize any inherent handling and kinking problems when handling large sheets of this material. Furthermore the nacreous pigments used have a mean particle size typically equal to or greater than 5 micrometer. When large particle are used in relatively thin layers of polymer, the surface roughness may be such that the roughness pattern may substantially reduce or eliminate the nacreous effect. It should be noted that very light patterns of roughness that do not totally block the nacreous appearance may be useful in creating a soft pearl-like iridescent appearance in combination with the nacreous pigments. At thickness higher than 150 micrometers, little improvement in either surface smoothness or mechanical properties are seen, and so there is little justification for the further increase in cost for extra materials.

For the biaxially oriented layer on the topside towards the image, suitable classes of thermoplastic polymers for the biaxially oriented sheet and the core matrix-polymer of the preferred composite sheet comprise polyolefins. Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polyethylene is preferred, as it is low in cost and has good adhesion properties to the photographic emulsion. The polyethylene layer may comprise at least one layer of said polymer base sheet and in particular it may comprises a layer on top of said polyester layer. When polyethylene is used with a polyester core, a polymer tie layer may be needed to further enhance the adhesion between the two polymers. Useful materials include modified copolymer of ethylene and acrylate such as DuPont Bynel.

Another means to enhance adhesion of a photographic silver halide emulsion or gel based coatings on the polyester polymer surface of this invention is to apply a subbing layer. Typical subbing layer may contain materials known in the art to promote adhesion to polyester and furthermore allow gelatin to adhere to the sub layer. Applying a latex subbing terpolymer of acrylonitrile, vinylidene chloride, and acrylic acid to the polyester support surface before drafting and tentering is useful when no polyethylene surface is desirable. The sub coat is applied to the polyester sheet, dried and the sheet is stretched and then a gelatin-based layer is coated on top of the sub coating. Additional the surface may be further treated by flame, plasma or corona discharge treatment to improve wetting and/or adhesion. In addition it is also possible to provide either an integral layer or a separately coated layer of either an electrical conductive or charge control layer to minimized the generation of electrostatic glow or discharge of a photosensitive imaging member. In a preferred embodiment of this invention the electrical conductive layer has a surface electrical resistance of less than $10^{12}$ log ohms per square. Electrical resistance greater than $10^{12}$ log ohms per square may result in static discharge which may fog a light sensitive photographic layer.

Addenda may be added to the top most skin layer to change the color of the imaging element. For photographic use, a white base with a slight bluish tinge is preferred. The addition of the slight bluish tinge may be accomplished by any process which is known in the art including the machine blending of color concentrate prior to extrusion and the melt extrusion of blue colorants that have been pre-blended at the desired blend ratio. Colored pigments that can resist extrusion temperatures greater than 320° C. are, preferred as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, Irgalite organic blue pigments and pigment Blue 60.

A finding that a very thin coating (0.2 to 1.5 micrometers) on the surface immediately below the emulsion layer can be made by coextrusion and subsequent stretching in the width and length direction. Addenda known in the art to emit visible light in the blue spectrum are preferred. Consumers generally prefer a slight blue tint to white defined as a negative b* compared to a white defined as a b* within one b* unit of zero. b* is the measure of yellow/blue in CIE space. A positive b* indicates yellow while a negative b* indicates blue. The addition of addenda that emits in the blue spectrum allows for tinting the support without the addition of colorants, which would decrease the whiteness of the image. The preferred emission is between 1 and 5 delta b* units. Delta b* is defined as the b* difference measured when a sample is illuminated ultraviolet light source and a light source without any significant ultraviolet energy. Delta b* is the preferred measure to determine the net effect of adding an optical brightener to the top biaxially oriented sheet of this invention. Emissions less than 1 b* unit can not be noticed by most customers therefore is it not cost effective to add optical brightener to the biaxially oriented sheet. An emission greater that 5 b* units would interfere with the color balance of the prints making the whites appear too blue for most consumers.

The preferred addendum of this invention is an optical brightener. An optical brightener is substantially colorless, fluorescent, organic compound that absorbs ultraviolet light and emits it as visible blue light. Examples include but are not limited to derivatives of 4,4'-diaminostilbene-2,2'-disulfonic acid, coumarin derivatives such as 4-methyl-7-diethylaminocoumarin, 1-4-Bis (O-Cyanostyryl) Benzol and 2-Amino-4-Methyl Phenol. An unexpected desirable feature of this efficient use of optical brightener. Because the ultraviolet source for a transmission display material is on the opposite side of the image, the ultraviolet light intensity is not reduced by ultraviolet filters common to imaging layers. The result is less optical brightener is required to achieve the desired background color.

The polyester utilized in the invention should have a glass transition temperature between about 50° C. and about 150° C., preferably about 60–100° C., should be orientable, and have an intrinsic viscosity of at least 0.50, preferably 0.6 to 0.9. Suitable polyesters include those produced from aromatic, aliphatic, or cyclo-aliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclobexane-dicarboxylic, sodiosulfoiso-phthalic, and mixtures thereof. Examples of suitable glycols include ethylene glycol, propylene glycol, butanediol, pentanediol, hexanediol, 1,4-cyclohexane-dimethanol, diethylene glycol, other polyethylene glycols and mixtures thereof Such polyesters are well known in the art and may be produced by well-known techniques, e.g., those described in U.S. Pat. Nos. 2,465,319 and 2,901,466. Preferred continuous matrix polymers are those having repeat units from terephthalic acid or naphthalene dicarboxylic acid and at least one glycol selected from ethylene glycol, 1,4-butanediol, and 1,4-cyclohexanedimethanol. Poly(ethylene terephthalate), which may be modified by small amounts of other monomers, is especially preferred. Polypropylene is also useful. Other suitable polyesters.include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402; and 4,468,510.

An opaque polymer base substantially free of voids is preferred because the voids at high levels of voiding may be prone to cracking when the print is placed under compression which is typical when prints are roughly handled. In one preferred embodiment of this invention, the presence of $TiO_2$ or other white pigment should be below the nacreous pigment such that they do not interfere with the nacreous appearance. The presence of $TiO_2$ below the nacreous pigment is preferred because it adds whiteness to the print. Typically thickness and concentration of the white pigment may be from 8 to 50 micrometers. The $TiO_2$ also gives the polymer support a slight yellow tint that is undesirable for a photographic display material. For use as a photographic reflective display material, a polymer support containing $TiO_2$ should also be tinted blue to offset the yellow tint of the polyester causing a loss in desired whiteness and adding cost to the print material. Concentration of the white pigment in the polyester layer allows for efficient use of the white pigment which improves image quality and reduces the cost of the imaging support. Useful ranges of $TiO_2$ concentration is between 6% and 50% by weight. Below 6% the level is sufficiently low that it has minimal effect on the overall sheet whiteness and above 50% it becomes increasing more to maintain good intralayer cohesion.

In the formation of photographic elements it is important that they be designed to efficiently transport through processing equipment to minimize jamming and other problems. In such a case the back of said imaging member may have a roughness of between 0.1 and 2.0 micrometers. This range of roughness helps to modify the frictional characteristics to optimize the photographic finishing and transport of this material. Furthermore it is also desirable to control the roughness characteristic of the top most side. In this case it is desirable to minimize roughness such that the pattern does not completely shutdown the nacreous appearance.

The structure of a preferred biaxially oriented coextruded sheet where the silver halide imaging layers are coated on the gelatin coated layer is as follows:

| |
|---|
| Gel sub<br>Primer |
| Clear polyester with blue pigments and optical brightener |
| Nacreous polyester layer<br>Solid polyester core with $TiO_2$<br>Antistat layer |

In a preferred embodiment of this invention the imaging element comprises in order an image receiving layer, a base member comprising a clear polymer adhesion promoting layer, a second layer of clear polymer, a polymer layer comprising nacreous pigment, a layer of polymer with white pigment, a pigment filled polymer layer, an adhesion promoting layer, and electrically conducting layer. Such an embodiment is preferred because it is a fully functionalized element that does not require further lamination or attachment to a base substrate. In this manner, costly manufacturing operations may be avoided.

In an additional embodiment of the above invention said pigment filled polymer layer that is located below a layer of polymer with white pigment contains flat platelet or needle shaped material. Suitable materials include mica or talc. The flat needle or platelet type materials help to provide increased modulus of the layer and therefore increases the overall stiffness of the imaging element.

In a preferred embodiment of this invention the imaging element has at least one layer of oriented polyester and nacreous pigment. The oriented polyester provides substantial bending resistance because of it high modulus while the polyester provides a medium in which to disperse the nacreous pigment. The nacreous pigment provides a unique look to the sheet and imaging applications. While the nacreous pigment may be coated without orientation, the orientation process enhances the strength provides of the sheet for subsequence handling and uses. The base member of the preferred embodiment of this invention has a surface roughness of between 0.2 and 1.2 Ra. Roughness greater than 1.2 Ra become excessive diffusive in their light scattering properties such that the nacreous appearance is obscured. Surface smoothness below 0.2 Ra is difficult to obtain and do not provide any appreciatively increase in the nacreous appearance. Low frequency surface roughness of backside biaxially oriented film or Ra is a measure of relatively finely spaced surface irregularities such as those produced on the backside of prior art photographic materials by the casting of polyethylene against a rough chilled roll. The low frequency surface roughness measurement is a measure of the maximum allowable roughness height expressed in units of micrometers and by use of the symbol Ra. For the irregular profile of the backside of photographic materials of this invention, the average peak to valley height, which is the average of the vertical distances between the elevation of the highest peak and that of the lowest valley, is used. Low frequency surface roughness, that is, surface roughness that has spatial frequency between 200 and 500 cycles/mm with a median peak to valley height greater than 1 $\mu$m. Low frequency roughness is the determining factor in how efficiently the imaging element is transported through photofinishing equipment, digital printers, and manufacturing processes. Low frequency roughness is commonly measured by surface measurement device such as a Perthometer.

In a further embodiment of this invention the imaging element has a FLOP of greater than 7. When the FLOP value is less than 7, the nacreous appearance is more difficult to see.

In an additional embodiment of this invention at least one layer of oriented polyester is substantially void free. By providing a polyester base that is substantially free of voids, the full effect of the nacreous pigment may be realized without the interference of a voided layer. In addition the solid layers of polymer provide a substantially rigid sheet that resists bending and cracking.

The imaging element of this invention may be either a stand along base member that has sufficient thickness that aids in conveyance through various pieces of equipment or it may be a thin sheet that is laminated to the upper surface of a substrate. Useful substrates include paper, cloth, plastic polymer webs such as polyester, polycarbonate, vinyl's or polyamides. Additional substrates may also include cloth or Tyvek-like material. The thin web nacreous polyester is preferred when it is desirable to provide the nacreous effect on different base substrates.

The addition of nacreous pigment to an oriented web such as polyester may be further enhanced with the addition of optical brightener. In another embodiment of this invention said imaging element has at least one layer containing optical brightener. Optical brighteners are known to absorb ultraviolet light and readmit it is the visible blue region. This effect is very useful when using metal oxide coated nacreous pigments. Typically these materials are not substantially white and the optical brighteners tends to enhance the whiteness perception.

In an additional embodiment of this invention the imaging element has at least one layer of polyester that is substantially free of nacreous pigment. Nacreous pigments typically have a large mean particle size in order to provide the desired nacreous appearance and therefore it may result in a rough surface. If the surface is sufficiently rough, the light entering the surface may be diffusely scattered and therefore with reduce the nacreous appearance. By providing a layer that is substantially free of nacreous pigment above a layer containing the nacreous pigment, the thickness of the clear layer is able to provide a smooth surface that enhances the nacreous appearance. In addition the clear layer provides an added perception of depth.

Since the nacreous pigments may have layers of metal oxide on a platelet like particle, the overall color appearance is shifted in color space from a neutral white appearance. In one embodiment of this invention the imaging element has white pigment below the nacreous pigment. This is preferred because the white pigment provides an added degree of whiteness to the print material that is desirable in imaging prints. Useful white pigments that may be used are $TiO_2$, $BaSO_4$, ZnS, ZnO, Talc, $CaCO_3$ and clay. The most preferred material is $TiO_2$ because of high degree of reflectivity and overall whiteness.

In an additional embodiment of this invention there is a polyolefin layer on the on the surface of the oriented polyester. When a photographic silver halide emulsion or other imaging layer that contains gelatin is used to provide the image, the adhesion of these layers to the base is important. Polyolefin and its copolymer derivatives may be used. In particular polyethylene is preferred to achieve good adhesion. In order to facilitate the adhesion of the polyethylene surface layer to the polyester base there should be a clear polymer layer. Such a clear polymer layer may comprise a modified copolymer of ethylene. This may be a melt extrudable blend of ethylene acrylate and polyethylene to obtain adhesion to the oriented polyester.

In a preferred embodiment of this the layer of oriented polyester and nacreous pigment further comprises between 4 and 50 reflection planes. Less than 4 reflection planes does not exhibit the nacreous effect while more than 50 reflection planes does not substantially improve the nacreous appearance.

In the most preferred said at least one layer of oriented polyester and nacreous pigment further comprises between 10 and 25 reflection planes. This range is preferred because above 25 the surface of the nacreous containing layer starts to progressively get rougher. With at least 10 reflection planes, the nacreous appearance provides a more satisfying image.

As used herein, the phrase "imaging element" is a material that utilizes either photosensitive silver halide in the formation of images or non-photographic technology in the formation of images. The imaging elements can be black-and-white, single color elements, or multicolor elements. Non-photographic imaging methods include thermal dye transfer, ink jet, electrophotographic, electrographic, flexographic printing, or rotogravure printing in an image receiving layer.

The preferred photographic elements of the present invention can be simple black-and-white or monochrome elements comprising a support bearing a layer of light-sensitive silver halide emulsion, or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

The light-sensitive silver halide emulsions employed in the photographic elements of this invention can include coarse, regular, or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions, although other hydrophilic colloids can be used in accordance with usual practice. Details regarding the silver halide emulsions are contained in and described in *Research Disclosure*, September 1994, Item 36544, Section I, published by Kenneth Mason Publications, Ltd., Dudley Annex, 12a North Street, Emsworth, Hampshire PO10 7DQ, ENGLAND as well as *Research Disclosure*, Item 36544, September 1994, and the references listed therein, as well as *Research Disclosure*, September 2000, Item 437013, published by Kenneth Mason Publications, Ltd., Dudley Annex, 12a North Street, Emsworth, Hampshire PO10 7DQ, ENGLAND.

The photographic silver halide emulsions utilized in this invention can contain other addenda conventional in the photographic art. Useful addenda are described, for example, in *Research Disclosure*, Item 36544, September 1994, and *Research Disclosure*, September 2000, Item 437013, published by Kenneth Mason Publications, Ltd., Dudley Annex, 12a North Street, Emsworth, Hampshire PO10 7DQ, ENGLAND. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

The thermal dye image-receiving layer of the receiving elements of the invention may comprise, for example, a polycarbonate, a polyurethane, a polyester, polyvinyl chloride, poly(styrene-co-acrylonitrile), poly(caprolactone), or mixtures thereof The dye image-receiving layer may be present in any amount which is effective for the intended purpose. In general, good results have been obtained at a concentration of from about 1 to about 10 $g/m^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye containing layer. Any dye can be used in the dye-donor employed in the invention, provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803; and 5,023,228.

As noted above, dye-donor elements are used to form a dye transfer image. Such a process comprises image-wise-heating, a dye-donor element, and transferring a dye image to a dye-receiving element as described above to form the dye transfer image.

In a preferred embodiment of the thermal dye transfer method of printing, a dye donor element is employed which comprises a poly-(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS0001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in detail in many books and patents. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog!or digital exposure, of a uniformly charged photoconductor. The photoconductor may be a single-use system, or it may be rechargeable and reimageable, like those based on selenium or organic photoreceptors.

In one form of the electrophotographic process, copiers use imagewise photodischarge, through analog or digital exposure, of a uniformly charged photoconductor. The photoconductor may be a single-use system, or it may be rechargeable and reimageable, like those based on selenium or organic photoreceptors.

In one form of the electrophotographic process, a photosensitive element is permanently imaged to form areas of differential conductivity. Uniform electrostatic charging, followed by differential discharge of the imaged element, creates an electrostatic image. These elements are called electrographic or xeroprinting masters because they can be repeatedly charged and developed after a single imaging exposure.

In an alternate electrographic process, electrostatic images are created ionographically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent, these toners form a film bonded to the paper. For heat-fusible toners, thermoplastic polymers are used as part of the particle. Heating both removes residual liquid and fixes the toner to paper.

The dye receiving layer (DRL) for ink jet imaging may be applied by any known methods, such as solvent coating or melt extrusion coating techniques. The DRL is coated over the tie layer (TL) at a thickness ranging from 0.1 to 10 $\mu$m, preferably 0.5 to 5 $\mu$m. There are many known formulations that may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al. in U.S. Pat. Nos. 4,879,166; 5,264,275; 5,104,730; 4,879,166; and Japanese Patents 1,095,091; ,2,276,671; 2,276,670; 4,267,180; 5,024,335; and 5,016,517 disclose aqueous based DRL formulations comprising mixtures of pseudo-bohemite and certain water soluble resins. Light, in U.S. Pat. Nos. 4,903,040; 4,930,041; 5,084,338; 5,126,194; 5,126,195; 5,139,8667; and 5,147,717 disclose aqueous-based DRL formulations comprising mixtures of vinyl pyrrolidone polymers and certain water-dispersible and/or water-soluble polyesters, along with other polymers and addenda. Butters et al in U.S. Pat. Nos. 4,857,386 and 5,102,717 disclose ink-absorbent resin layers comprising mixtures of vinyl pyrrolidone polymers and acrylic or methacrylic polymers. Sato et al in U.S. Pat. No. 5,194,317, and Higuma et al, in U.S. Pat. No. 5,059,983, disclose aqueous-coatable DRL formulations based on poly (vinyl alcohol). Iqbal in U.S. Pat. No. 5,208,092 discloses water-based ink receiving layer (IRL) formulations comprising vinyl copolymers which are subsequently cross-linked. In addition to these examples, there may be other known or contemplated DRL formulations that are consistent with the aforementioned primary and secondary requirements of the DRL, all of which fall under the spirit and scope of the current invention.

The preferred DRL is a 0.1 to 10 $\mu$m DRL which is coated as an aqueous dispersion of 5 parts alumoxane and 5 pails poly (vinyl pyrrolidone). The DRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers, and the like.

Although the ink-receiving elements as described above can be successfully used to achieve the objectives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118; 5,027,131; and 5,102,717; and in European Patent Specification 0 524 626. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention.

These and other advantages will be apparent from the detailed description below.

The following examples illustrate the practice of this invention. They are not intended to be exhaustive of all possible variations of the invention. Parts and percentages are by weight unless otherwise indicated.

EXAMPLES

Example 1

The proposed laminated photographic base was prepared by extrusion laminating the following sheets to both sides of a photographic grade polyester support:

Top Polymer Sheet:

A composite 5 layer biaxially oriented polyester sheet (56.2 micrometers thick) (d=1.4 g/cc) consisting of a nacreous layer, and a layer of with a titanium dioxide pigmented below the nacreous pigment. There was a clear polyester layer on top of the nacreous layer and a primed and gel subbed layer directly under the image layer.

Bottom Biaxially Oriented Polyester Sheet:

A two-layer oriented polyester sheet consisting a core polyester layer and a skin layer of polyester that contains 10% by weight of a 5 micrometer silica addenda for photoprocessing conveyance. The two layer sheet was 25 micrometers thick (d=1.4 g/cc).

Both the above top and bottom.sheets were extrusion laminated to a photographic grade polyester base using a clear blend (80/20) of an a 13 melt index low density polyethylene (d=0.910 g/cc) and Dupont Bynel at 315C. The web sheets were brought together with molten polymer between the two sheets in a pressure-loaded nip.

The structure of the nacreous support was as follows:

| | | |
|---|---|---|
| L1 | Silver Halide formed Image | |
| L2 | Gelatin Sub | |
| L3 | Primer layer | |
| L4 | Clear Polyester + blue tint | 1.2 Micrometers |
| L5 | Clear polyester with Optical Brightener | 12 Micrometers |
| L6 | Polyester polymer + metal oxide particle | 29.8 Micrometers |
| L7 | 40% $TiO_2$ filled polyester | 12 Micrometers |

-continued

| | | |
|---|---|---|
| L8 | Clear polyester | 1.2 Micrometers |
| L9 | 80/20 Blend of Low Density PE and Dupont Bynel (copolymers of ethylene acrylate) | 10 Micrometers |
| L10 | photo grade polyester | 102 Micrometers |
| L11 | 80/20 Blend of Low Density PE and Dupont Bynel | 10 Micrometers |
| L12 | Biaxially oriented Polyester matte film (2 layers) | 25 Micrometers |
| L13 | Conductive/Writable antistat | |

L1 is the image layer. This is a 3 color layer photographic with appropriate interlayers and SOC. Details regarding the silver halide emulsions are contained in and described in *Research Disclosure*, September 1994, Item 36544, Section I, published by Kenneth Mason Publications, Ltd., Dudley Annex, 12a North Street, Emsworth, Hampshire PO10 7DQ, ENGLAND as well as *Research Disclosure*, Item 36544, September 1994, and the references listed therein, as well as *Research Disclosure*, September 2000, Item 437013, published by Kenneth Mason Publications, Ltd., Dudley Annex, 12a North Street, Emsworth, Hampshire PO-10 7DQ, ENGLAND.

The photographic silver halide emulsions utilized in this invention can contain other addenda conventional in the photographic art. Useful addenda are described, for example, in *Research Disclosure*, Item 36544, September 1994, and *Research Disclosure*, September 2000, Item 437013, published by Kenneth Mason Publications, Ltd., Dudley Annex, 12a North Street, Emsworth, Hampshire PO10 7DQ, ENGLAND. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

L2–L8 is an integral biaxially polyester polymer sheet. The L2 layer is a gelatin sub that is attached to a primer subbing layer(L3) of latex terpolymer of acrylonitrile, vinylidene chloride, and acrylic acid The materials were prepared as per Examples 1 and 3 of U.S. Pat. No. 5,876,910. L4 and L5 are essentially clear layers of polyester. L4 contains a small amount of blue tint (Sheppard Blue) to help offset the native yellowness of the gelatin layer while L5 contains 0.5% Uvitex OB optical brightener. The L6 layer contains a metal oxide coated pigment (Afflair 110 from EM Industries,Inc.) at 5% by weight. L7 in another polyester layer that is filled with 40% by weight of $TiO_2$. L8 is a thin clear layer of polyester to help provide structural balance to the polyester sheet. This sheet would be prepared by melt coextrusion of the layers that are jointed in a feedblock that flows into a coat-hanger die. The extrudate is cast onto a smooth surface roller and quenched in a water bath. The sheet is then stretched in the machine direction 3 times coated with the latex terpolymer, dried and then stretched in the cross direction 3 times. The polyester sheet is heat set and heat relaxed and then wound in roll form.

L9 is a tie layer to adhere the integral sheet and image to the base substrate and is an 80/20 blend of low density polyethylene and Dupont Bynel L10 is a 102-micrometer thick photo grade polyester base substrate.

L11 is a tie layer of an 80/20 blend of low density polyethylene and Dupont Bynel to adhere the matte backside film (L12) to the backside of the polyester base sheet.

L12 is a 2 layer performed cast extruded and stretched polyester sheet. The bottom layer is 8 micrometers of polyester and is 10% by weight silica particle (Syloid 72) addenda for photoprocessing conveyance.

L13 is a writable/conductive layer and may further provide frictional properties.

Example 2

Control

This example was standard photographic grade polyester that contained approximately 10% by weight of BaSO4. There is a primer and gel sub layer on each side as described in example 1. The topside of the example was coated with the same photographic layer as in example 1. The bottom most layer was coated with the same writable/conductive layer as described above.

TABLE 1

| Example | Nacreous Appearance |
|---|---|
| 1 | Yes |
| 2 (Control) | No |

As noted in table one, example 1 that contained a nacreous pigment showed the nacreous appearance while sample 2 (Control) without the nacreous pigment did not demonstrate the effect.

The invention has been described in detail with particular reference to certain preferred embodiments thereof, but it will be understood that variations and modifications can be effected within the spirit and scope of the invention.

What is claimed is:

1. An imaging element comprising an oriented polyester sheet wherein said sheet comprises at least one layer of oriented polyester and nacreous pigment, and at least one layer of polyester substantially free of nacreous pigment.

2. An imaging element of claim 1 wherein said at least one layer of oriented polyester is substantially void free.

3. An imaging element of claim 1 wherein said at least one layer of oriented polyester is laminated on the upper surface of a substrate.

4. An imaging element of claim 3 wherein said substrate comprises at least one material from the group consisting of paper, cloth, polyester, polycarbonate, vinyl and polyamide.

5. An imaging element of claim 1 wherein said at least one layer comprising polyester and nacreous pigment further comprises optical brightener.

6. The imaging element of claim 1 wherein said at least one layer of oriented polyester and nacreous pigment further comprises between 10 and 25 reflection planes.

7. An imaging element of claim 1 further comprising at least one layer, below said layer comprising nacreous pigment, that comprises white pigment.

8. An imaging element of claim 1 further comprising an olefin containing layer on the surface of said at least one oriented polyester layer.

9. An imaging element of claim 8 further comprising a tie layer between said olefin containing layer and said at least one oriented polyester layer.

10. The imaging element of claim 1 wherein said imaging element comprises in order an image receiving layer, a base member comprising a clear polymer adhesion promoting layer, a second layer of clear polymer, a polyester polymer layer comprising nacreous pigment, a layer of polymer with white pigment, a pigment filled polymer layer, an adhesion promoting layer, and electrically conducting layer.

11. The imaging element of claim 10 wherein said base member has a surface roughness of between 0.2–1.2 Ra.

12. The imaging element of claim 10 wherein said clear polymer adhesion promoting layer further comprises an upper surface of polyethylene imine.

13. The imaging element of claim 10 wherein second layer of clear polymer comprises a modified copolymer of ethylene.

14. The imaging element of claim 10 wherein said polymer with white pigment comprises $TiO_2$.

15. The imaging element of claim 10 wherein said nacreous pigment filled polymer layer comprises flat platelet or needle shaped pigment material.

16. The imaging element of claim 10 wherein said adhesion promoting layer further comprises a subbing layer of latex terpolymer of acrylonitrile, vinylidene chloride, and acrylic acid and a layer of gelatin.

17. The imaging element of claim 10 wherein said electrically conducting layer has a surface electrical resistance of less than $10^{12}$ log ohms per square.

18. The imaging element of claim 1 wherein said element has a FLOP of greater than 7.

19. The imaging element of claim 1 wherein said at least one layer of oriented polyolefin and nacreous pigment further comprises between 4 and 50 reflection planes.

20. An imaging element comprising an oriented polyester sheet wherein said sheet comprises at least one layer of oriented polyester and nacreous pigment and further comprising at least one layer, below said layer comprising nacreous pigment, that comprises white pigment.

21. An imaging element of claim 20 wherein said oriented polyester sheet comprises at least one layer of oriented polyester that is substantially void free.

22. An imaging element of claim 20 wherein said oriented polyester sheet is laminated on the upper surface of a substrate.

23. An imaging element of claim 22 wherein said substrate comprises at least one material from the group consisting of paper, cloth, polyester, polycarbonate, vinyl and polyamide.

24. An imaging element of claim 22 wherein said at least one layer comprising polyester and nacreous pigment further comprises optical brightener.

25. An imaging element of claim 23 wherein said at least one layer of polyester is substantially free of nacreous pigment.

26. The imaging element of claim 20 wherein said imaging element comprises in order an image receiving layer, a base member comprising a clear polymer adhesion promoting layer, a second layer of clear polymer, a polyester polymer layer comprising nacreous pigment, a layer of polymer with white pigment, a pigment filled polymer layer, an adhesion promoting layer, and electrically conducting layer.

27. The imaging element of claim 26 wherein said base member has a surface roughness of between 0.2–1.2 Ra.

28. The imaging element of claim 26 wherein second layer of clear polymer comprises a modified copolymer of ethylene.

29. The imaging element of claim 26 wherein said nacreous pigment filled polymer layer comprises flat platelet or needle shaped nacreous material.

30. The imaging element of claim 26 wherein said electrically conducting layer has a surface electrical resistance of less than $10^{12}$ log ohms per square.

31. The imaging element of claim 20 wherein said element has a FLOP of greater than 7.

32. The imaging element of claim 20 wherein said at least one layer of oriented polyester and nacreous pigment further comprises between 4 and 50 reflection planes.

33. The imaging element of claim 20 wherein said at least one layer of oriented polyolefin and nacreous pigment further comprises between 10 and 25 reflection planes.

34. An imaging element comprising an oriented polyester sheet wherein said sheet comprises at least one layer of oriented polyester and nacreous pigment and further comprising an olefin containing layer on the surface of said at least one oriented polyester layer.

35. An imaging element of claim 34 wherein said at least one layer of oriented polyester is substantially void free.

36. An imaging element of claim 1 wherein said oriented polyester sheet comprises at least one layer of oriented polyester is laminated on the upper surface of a substrate.

37. An imaging element of claim 36 wherein said substrate comprises at least one material from the group consisting of paper, cloth, polyester, polycarbonate, vinyl and polyamide.

38. An imaging element of claim 34 wherein said at least one layer comprising polyester and nacreous pigment further comprises optical brightener.

39. An imaging element of claim 35 wherein said at least one layer of said polyester sheet is substantially free of nacreous pigment.

40. The imaging element of claim 34 wherein said imaging element comprises in order an image receiving layer, a base member comprising a clear polymer adhesion promoting layer, a second layer of clear polymer, a polyester polymer layer comprising nacreous pigment, a layer of polymer with white pigment, a pigment filled polymer layer, an adhesion promoting layer, and electrically conducting layer.

41. The imaging element of claim 40 wherein said pigment filled polymer layer comprises flat platelet or needle shaped nacreous material.

42. The imaging element of claim 34 wherein said element has a FLOP of greater than 7.

43. An imaging element of claim 42 further comprising at least one layer, below said layer comprising nacreous pigment, that comprises white pigment.

44. The imaging element of claim 34 wherein said at least one layer of oriented polyolefin and nacreous pigment further comprises between 10 and 25 reflection planes.

* * * * *